US007571833B2

(12) United States Patent
Smith et al.

(10) Patent No.: US 7,571,833 B2
(45) Date of Patent: Aug. 11, 2009

(54) BULK COIN DISPENSER

(75) Inventors: Michael J. Smith, Scottsburg, IN (US); Scott H. Meeker, Temecula, CA (US)

(73) Assignee: FKI Security Products, New Albany, IN (US)

( * ) Notice: Subject to any disclaimer, the term of this patent is extended or adjusted under 35 U.S.C. 154(b) by 18 days.

(21) Appl. No.: 11/290,755

(22) Filed: Nov. 30, 2005

(65) Prior Publication Data

US 2007/0124021 A1 May 31, 2007

(51) Int. Cl.
*B65H 3/00* (2006.01)

(52) U.S. Cl. ..... 221/277; 221/311; 221/9; 221/123; 700/231; 700/232; 700/241

(58) Field of Classification Search ..... 700/231–244; 221/1–312 C
See application file for complete search history.

(56) References Cited

U.S. PATENT DOCUMENTS 2,358,563 A * 9/1944 Donaldson ..... 221/109
3,311,008 A * 3/1967 Schubert ..... 83/27
4,717,044 A * 1/1988 Suzuki et al. ..... 221/130
4,860,922 A 8/1989 Malservisi et al.
4,940,162 A 7/1990 Thie
4,966,304 A 10/1990 Kelly
5,110,009 A 5/1992 Gartner et al.
5,722,564 A * 3/1998 Tiraboschi ..... 221/131
5,848,725 A * 12/1998 Saeki ..... 221/131
5,899,358 A 5/1999 Daumueller
5,938,072 A * 8/1999 Lamoureux et al. ..... 221/253
5,984,509 A * 11/1999 Scott ..... 700/237
6,202,006 B1 * 3/2001 Scott ..... 700/231
6,582,037 B1 * 6/2003 Rudick et al. ..... 312/334.22
6,682,289 B1 * 1/2004 Credle, Jr. ..... 414/281
7,111,754 B1 * 9/2006 Siemens ..... 221/266

* cited by examiner

*Primary Examiner*—Gene Crawford
*Assistant Examiner*—Michael K Collins
(74) *Attorney, Agent, or Firm*—Brooks Kushman P.C.

(57) ABSTRACT

Bulk coins dispenser having a rotary dispensing member. Rotation of the rotary dispensing member being controllable to control dispensing of coins stored therein. The coins may be packaged into coin rolls and controllably dispensed from the bulk coin dispenser.

14 Claims, 4 Drawing Sheets

BULK COIN DISPENSER

BACKGROUND OF THE INVENTION

1. Field of the Invention

The present invention relates to bulk coin dispensers.

2. Background Art

Enterprises requiring the exchanged of coins, such as stores and banks, require relatively large quantities of nickels, dimes, quarters, and other denominations of change to facilitate activities. Commonly, the coins are prepackaged into coin rolls and delivered to the enterprises in lump sums. Large quantities of coins may be delivered to the enterprises such that the enterprises become responsible for the storage and dispensing thereof. As such, a need exists to provide such enterprises with a device to facilitate storing and dispensing of the coins.

SUMMARY OF THE INVENTION

One non-limiting aspect of the present invention relates to a bulk coin dispenser configured to facilitate storing and dispensing coins packaged in coin rolls.

One non-limiting aspect of the present invention relates to a bulk coin dispenser. The dispenser may include a magazine configured for holding a number of coin rolls and a rotary dispensing member included within the magazine to dispense the coin rolls.

The dispenser may further include an electronically controlled motor for controlling rotation of the rotary device, and thereby, dispensing of the coin rolls. A control module can be included and in communication with the motor for controlling rotation of the rotary device, and thereby, dispensing of the coin rolls. Optionally, an electronic sensor may be included for monitoring dispensing of the coin rolls, and the control module may be in communication with the sensor to control dispensing of the coin rolls as a function thereof.

The dispenser may further include a number of fingers attached to the rotary dispensing member to facilitate dispensing of the coin rolls. Optionally, the rotary dispensing member may be circular in shape and include the fingers on an outer perimeter thereof such that successive fingers define an opening for receiving one or more coin rolls.

The dispenser may further include a loading ramp within the magazine for facilitating loading of the coin rolls relative to the rotary member so as to facilitate the dispensing by the rotary device.

The dispenser may further include a housing for receiving the magazine, the housing including an opening covered with a lockable door through which the magazine is received.

The dispenser may further include a tray extendable beyond the opening to facilitate receiving the magazine. Optionally, the tray may include a number of tracks for receiving a number of magazines so that a number of magazines within the housing may be used for dispensing coin rolls of different denominations.

The dispenser may further include an electronic control module for individually controlling dispensing of the different coin roll denominations by controlling rotary dispensing members associated with each magazine.

The dispenser may further include a collection tray for collecting the dispensed coin rolls for subsequent retrieval.

The dispenser may be configured to store the coin rolls such that the coin rolls are stacked on top of each other along a longitudinal axis so as to permit rolling of the stack coin rolls towards the dispensing feature to facilitate the dispensing thereof.

Optionally, the rotary dispensing member may include a number of blades, each blade rotating with rotation of the other blades to facilitate dispensing the coin rolls.

One non-limiting aspect of the present invention relates to a computer-readable medium for facilitating dispensing of coin rolls from a bulk coin dispenser having a rotary dispensing member configured to receive the coin rolls, the rotary dispensing member in communication with an electronically controlled motor configured to receive instructions for controlling the rotation thereof. The computer-readable medium may include instructions for controlling rotation of the rotary dispensing member in such as manner as to control dispensing of the coin rolls.

The computer-readable medium may further include instruction s for selectively controlling rotation of a number of rotary dispensing members included within the dispenser.

The computer-readable medium may further include instructions for controlling dispensing members as a function of coin roll denominations associated therewith.

The computer-readable medium may further include instructions for tracking a number of coin rolls being dispensed and instructions for controlling operation of the rotary dispensing member as a function thereof.

The above features and advantages, along with other features and advantages of the present invention, are readily apparent from the following detailed description of the invention when taken in connection with the accompanying drawings.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
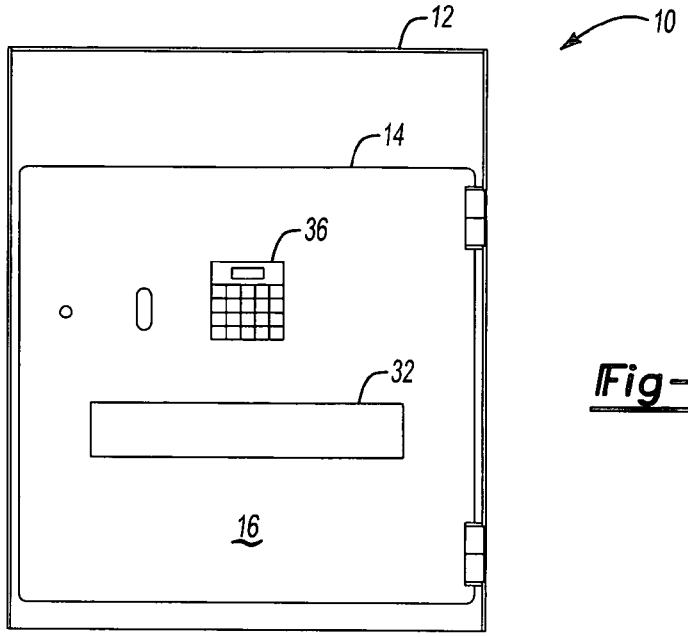
FIGS. 1-2 illustrate a bulk coin dispenser in accordance with one non-limiting aspect of the present invention.
Figure 2:
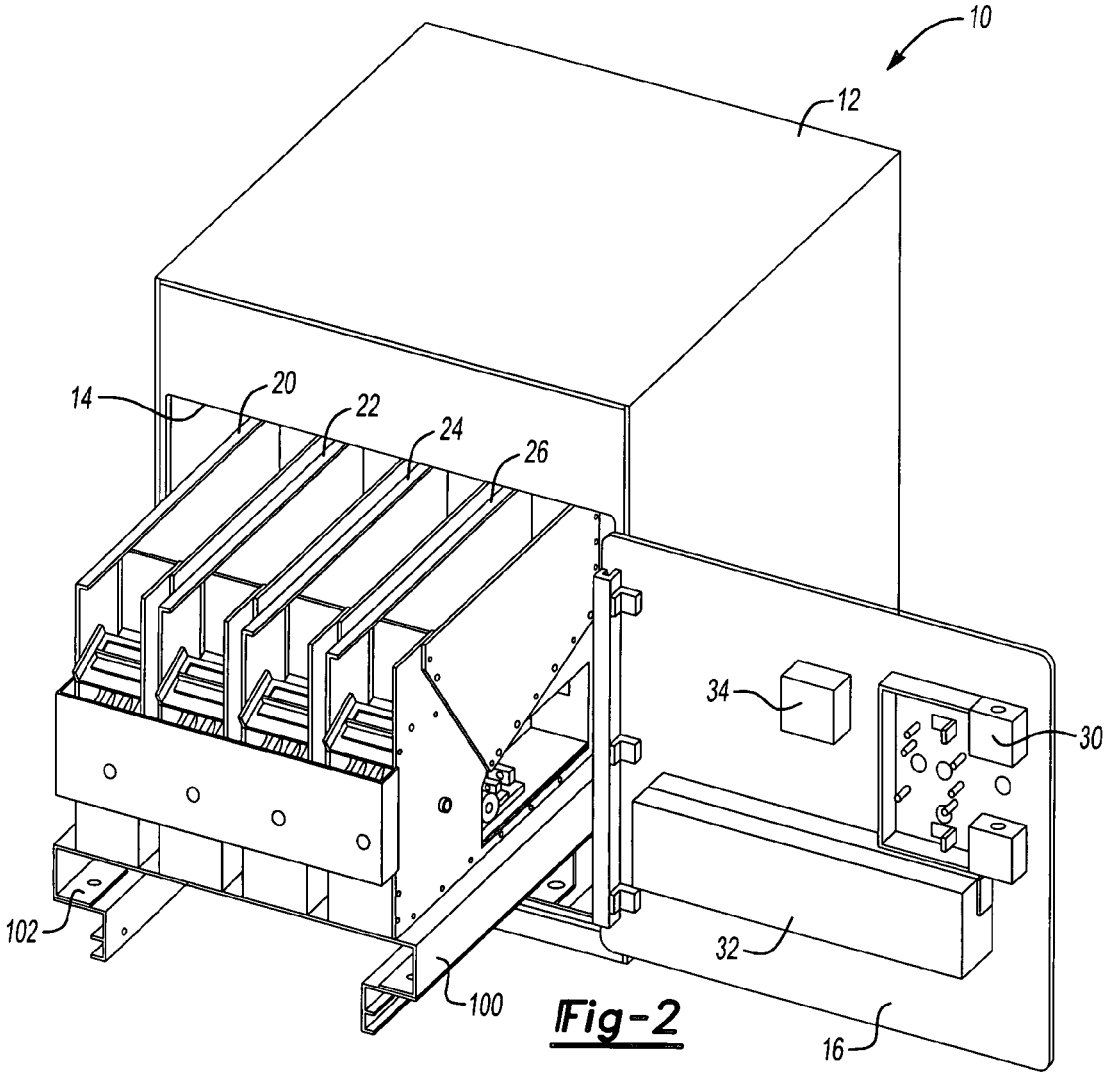

FIGS. 1-2 illustrate a bulk coin dispenser 10 in accordance with one non-limiting aspect of the present invention. The coin dispenser 10 may be used in any number of environments to facilitate dispensing coins, as described below in more detail. The coin dispenser 10 may include a housing 12 having an opening 14 covered with a lockable door 16. A number of magazines 20, 22, 24, 26 may be inserted within the housing 12 to store coin rolls.

The housing 12 may be a material suitable for protecting the coins from theft, water, fire, and other hazards. The door 16 may include a lock 30 for locking the door 16 and securing storage of the magazines 20, 22, 24, 26 within the housing 12. The lock 30 may be mechanically and/or electrically controlled to secure the door 16. The door 16 may further include a coin collection tray 32 for dispensing the coin rolls through a front-side thereof, such as to permit dispensing of the coin rolls without requiring opening of the door 16, thereby, maintaining integrity and storage of the coin rolls.

An electronic control module 34 may be included to facilitate electronically controlling dispensing operations. The control module 34 may communicate with a keypad 36 on the front-side of the dispenser 10 to permit a user to request dispensing of the coin rolls and/or it may communicate with a remote network element (not show) to perform similar operations. The control module 34 may keep track of the amount of coins within the dispenser 10 and the dispensing thereof, such as to track individuals requesting coins and the number of coins available from the dispenser 10, which can be helpful in maintaining sufficient numbers of coins within the dispenser 10.

Figure 3:
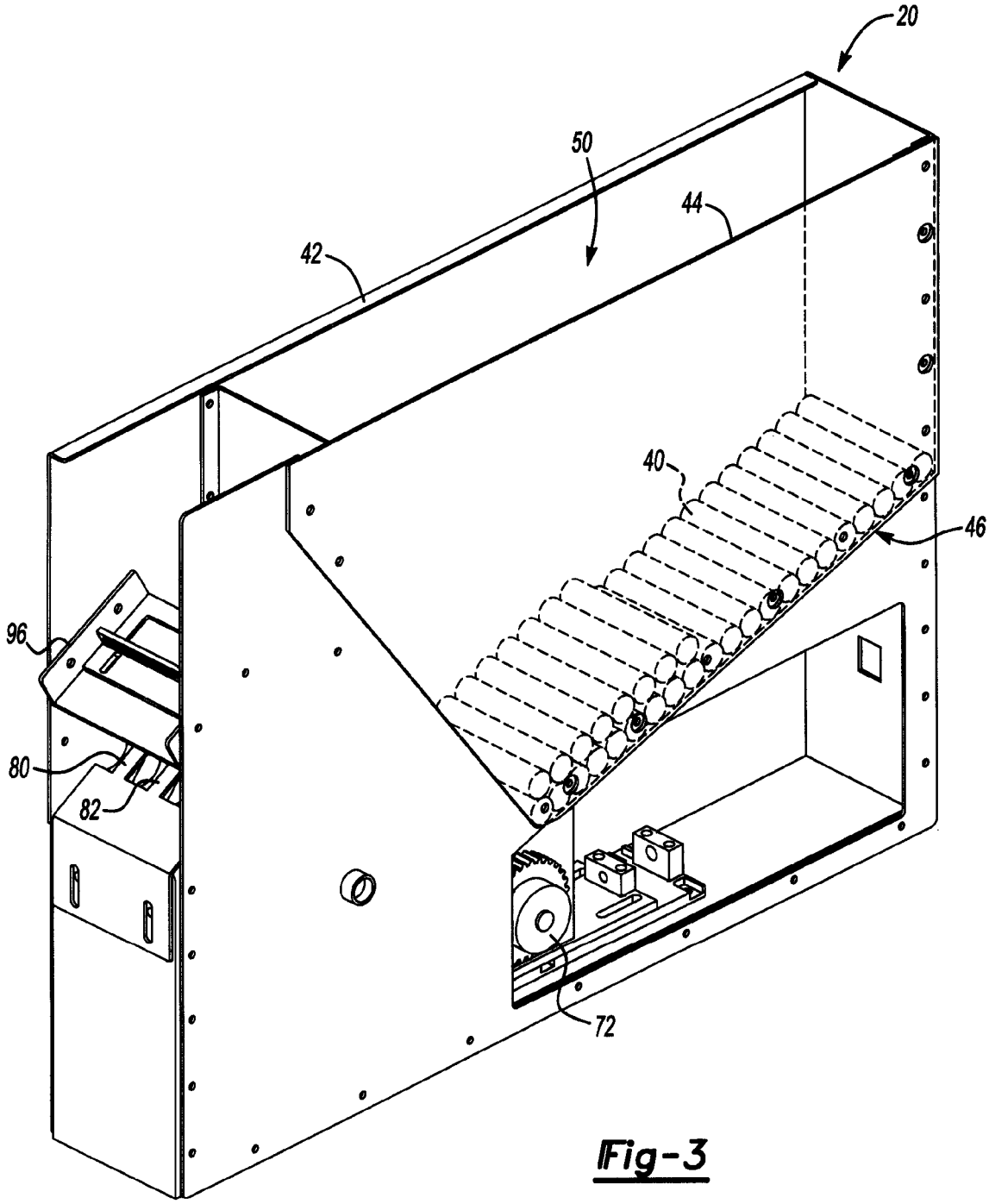
FIGS. 3-4 illustrate one of the magazines in accordance with one non-limiting aspect of the present invention.
Figure 4:
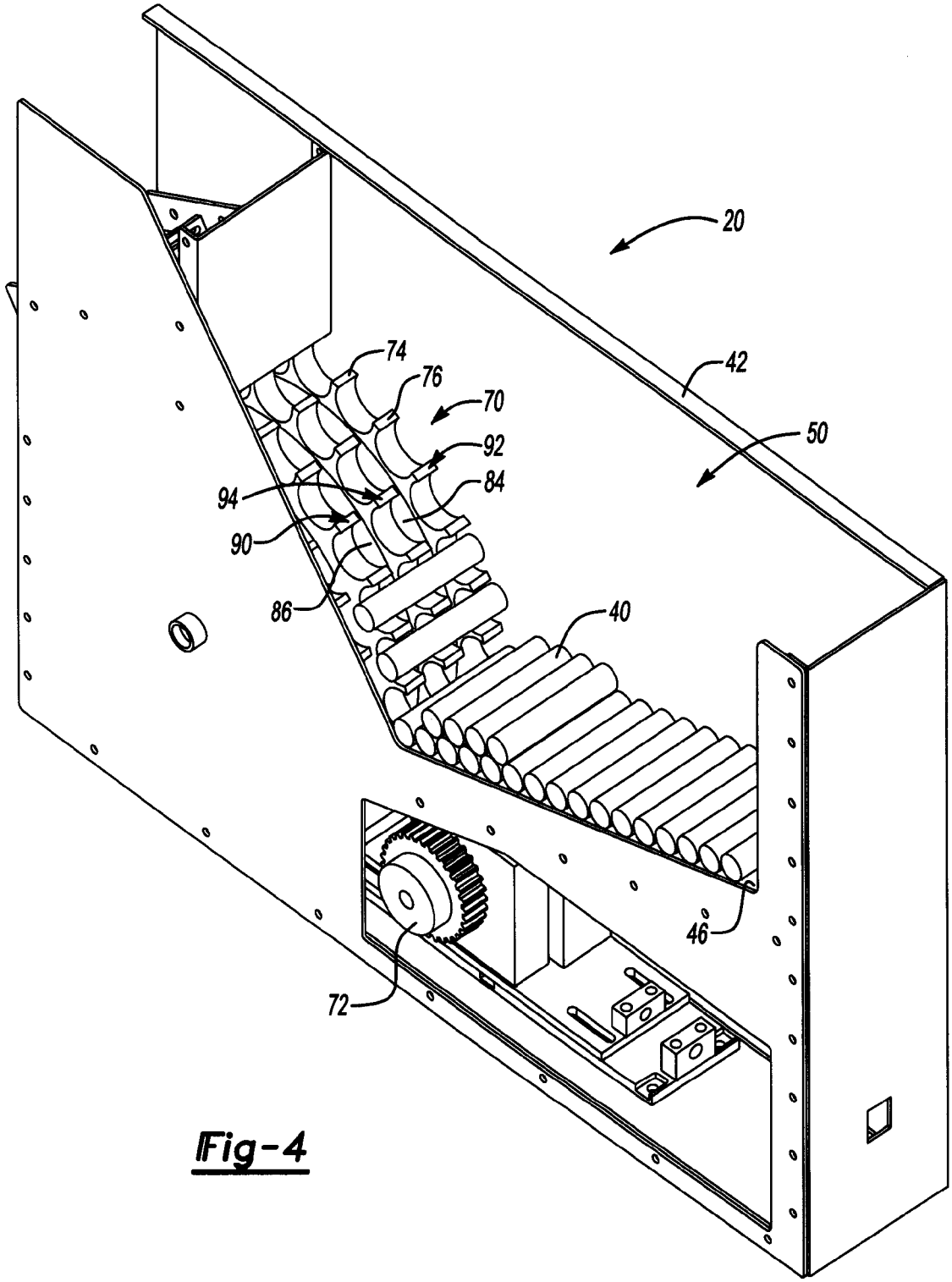

FIGS. 3-4 illustrate one of the magazines 20 in accordance with one non-limiting aspect of the present invention. The magazine 20 is generally elongated in shape to permit storage of coin rolls 40 (shown in phantom). The magazine 20 may include opposed side walls 42, 44 and a ramp 46 for defining a storage area 50 for the coin rolls 40. The storage area 50 may be dimensioned to correspond with a longitudinal dimension of particular coin denominations and/or it may be of a dimension sufficient to hold coin rolls of varying denominations.

Figure 5:
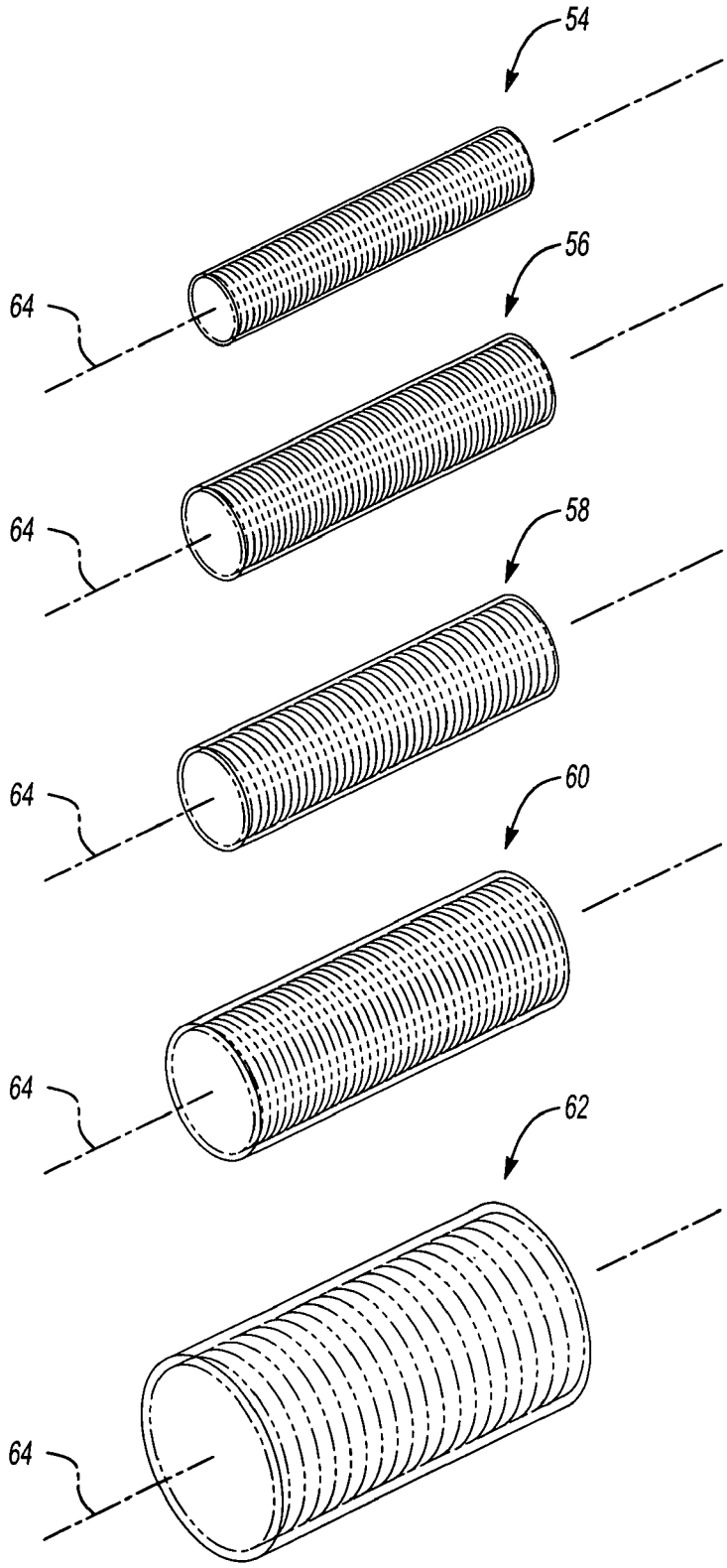
FIG. 5 illustrates a number of coin roils of varying denominations.

FIG. 5 illustrates a number of coin roils 54, 56, 58, 60, 62 of varying denominations. The illustrated denominations relate to a dime roll 54, penny roll 56, nickel roll 58, quarter roll 60, and half-dollar roll 62, however, any number of denominations may be used without deviating from the scope and contemplation of the present invention. The coin rolls 54, 56, 58, 60, 62 are generally elongated along an longitudinal axis 64 and may be pre-packaged in plastic, paper, or some other material to facilitate the packaging and storing thereof within the magazine 20.

A radial and longitudinal axis dimensions of the coin rolls 54, 56, 58, 60, 62 may vary according to the associated denomination. For example, the dime roll 54 may have a smaller radial and longitudinal axis dimension than the quarter roll 60, as one having ordinary skill in the art will appreciate. The dimensioning of the magazine storage area 50 may correspond to these variables and/or, such as to support magazine uniformity and interchangeability, the storage area 50, and attendant magazine dimensions, may be selected to correspond with the dimension of the largest coin roll intended for storage.

Returning to FIGS. 3-4, a number of coin rolls 40 may be longitudinally stacked within the magazine storage area 50, such as by a user placing the coin rolls 40 within the storage area through an opening in a top-side thereof. The ramp may be downwardly angled such that gravity causes the coin rolls 40 to roll towards a rotary dispensing member 70. The rotary dispensing member 70 may be mechanically driven and electronically controlled to facilitate dispensing one or more of coin rolls 40 stacked in the magazine 20.

In more detail, an electrically controlled motor 72 may be included within the magazine 20 to rotate the dispensing member 70. Successive fingers 74, 76 on the perimeter of the rotary dispensing member 70 may create an opening sufficient to receive one or more loaded coin rolls 40 for dispensing. For example, the ramp 46 may be used to load the coin rolls 40 into the spaces between the fingers 74, 76 and the motor 72 may be controlled to rotate the dispensing member 70 such that the loaded coin rolls 40 are rotated forwardly for dispensing to the coin collection tray 32.

A set of prongs 80, 82 may be included at the front end of the magazine 20 to interact with channels 84, 86 in the rotary member 70 to facilitate dislodging the loaded coin rolls 40. The dislodged coin rolls 40 may then free fall into the coin collection tray 32 for retrieval. The rotary dispensing member 70 may include the fingers 74, 76 on a number of axially spaced blades 90, 92, 94 such the space between the blades 90, 92, 94 define the channels 84, 86 used by the prongs 80, 82 to dislodge the loaded coin rolls 40.

An electronic sensor 96 may be included proximate the prongs 80, 82 to facilitate tracking and monitoring coin dispensing. The sensor 96 may be configured to electronically count the number of coin rolls 40 being dispensed and to report that information back to the electronic control module 34 and/or a remotely located network element. This information may then be coupled with the denomination associated therewith for tracking the dispensing operations, either by the control module 34 or some other element in communication therewith.

As shown in FIG. 2, multiple magazines 20, 22, 24, 26 of varying denominations may be included within the dispenser 10 and secured when the door 16 is closed. An authorized user may request rolls of quarters, dimes, and nickels and the control module 32 may selectively control each rotary member of the magazine 20, 22, 24, 26 having the requested denomination to cause the desired number of rolls to be dispensed. The sensor 96 may be used with this action to count the number of coin rolls 40 dispensed so as to prevent dispensing of unauthorized quantities of coin rolls 40.

The present invention contemplates the use of other features without deviating from the scope and contemplation of the present invention. For example, a push-rod or other feature (not shown) may be included to facilitate loading of the coin rolls 40 within the rotary dispensing member 70. The push-rod may be a feature included within the storage area to push against the rear coin rolls 40 such that pressure causes the other coin rolls 40 to roll towards the rotary dispensing member 70, and thereby, facilitate the loading thereof.

The illustrated magazines 20, 22, 24, 26 are of a uniform dimension such that each magazine 20, 22, 24, 26 occupies the same footprint within the housing 12. The present invention, however, is not so limited and fully contemplates the use of any number of differently sized magazines 20, 22, 24, 26 and any number of corresponding denominations. Optionally, each magazine 20, 22, 24, 26 may include an electronic chip or other electronic feature for identifying the denominations and quantity of coin rolls 40 associated therewith. Furthermore, the magazines 20, 22, 24, 26 may arrive pre-loaded with coin rolls 40 and simply inserted within the housing 12 for storage, rather than requiring a user to place the coin rolls 40 within the storage area 50, as described above.

Optionally, the housing 12 may include an extendable tray 100 for receiving the magazines 20, 22, 24, 26. The tray 100 me be pulled out through the opening 14 when the door 16 is open. This may be helpful in loading the coin rolls 40 in the storage area 40 and/or to facilitate replacement of the magazines 20, 22, 24, 26. An optional lock receiving member 102 may be included within the track of the tray 100 to prevent retraction of the tray 100 when the door 16 is opened, i.e., a lock (not shown) may be included within the housing 12 to retrain the tray 100. This may be used to enhance security by preventing tray 100 removal unless a separate password or code is entered into the keypad.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A bulk coin dispenser, the dispenser comprising:

a magazine configured for holding a number of coin rolls;

a rotary dispensing member included within the magazine to dispense the coin rolls;

a pair of prongs configured to engage an underside of the coin rolls proximate a front end of the magazine from which the coin rolls exit the magazine, the prongs being configured to facilitate dislodging the coin rolls from the rotary dispensing member;

wherein the rotary dispensing member includes a number of blades spaced apart along a length of the coin rolls, each blade rotating with rotation of the other blades to facilitate dispensing the coin rolls;

wherein the blades are spaced apart to form at least two separate channels, the prongs being located at a fixed location within the channels to successively engage the underside of each coin roll carried by the rotary dispensing member; and wherein the prongs remain at the fixed location within the channels throughout a full 360° rotation of the rotary dispensing member to engage the underside of each coin roll carried by the rotary dispensing member.

2. The dispenser of claim 1 further comprising an electronically controlled motor for controlling rotation of the rotary dispensing member, and thereby, dispensing of the coin rolls.

3. The dispenser of claim 2 further comprising a control module in communication with the motor, the control module controlling rotation of the rotary device, and thereby, dispensing of the coin rolls.

4. The dispenser of claim 3 further comprising an electronic sensor for monitoring dispensing of the coin rolls, the control module being in communication with the sensor to control dispensing of the coin rolls as a function thereof.

5. The dispenser of claim 1 wherein the rotary dispensing member is circular in shape and includes grooves on an outer perimeter thereof for receiving the coin rolls.

6. The dispenser of claim 1 further comprising a loading ramp within the magazine for facilitating loading of the coin rolls relative to the rotary member so as to facilitate the dispensing by the rotary device.

7. The dispenser of claim 1 further comprising a housing for receiving the magazine, the housing including an opening covered with a lockable door through which the magazine is received.

8. The dispenser of claim 7 further comprising a tray extendable beyond the opening to facilitate receiving the magazine.

9. The dispenser of claim 8 wherein the tray includes a number of tracks for receiving a number of magazines.

10. The dispenser of claim 7 further comprising a number of magazines within the housing for dispensing coin rolls of different denominations.

11. The dispenser of claim 10 further comprising an electronic control module for individually controlling dispensing of the different coin roll denominations by controlling rotary dispensing members associated with each magazine.

12. The dispenser of claim 1 further comprising a collection tray for collecting the dispensed coin rolls for subsequent retrieval.

13. The dispenser of claim 1 wherein the magazine is configured to store the coin rolls such that the coin rolls are stacked on top of each other to an elevatation above a portion of the dispensing member such that a portion of the stacked coin rolls overlap a portion of the dispensing member.

14. The dispenser of claim 13 wherein the magazine is configured to permit the stacked coin rolls to roll towards the dispensing feature to facilitate the dispensing thereof.

* * * * *